US007882717B2

(12) United States Patent
Widdemer

(10) Patent No.: US 7,882,717 B2
(45) Date of Patent: Feb. 8, 2011

(54) RESIN PARTICLE REINFORCED LEATHER PRODUCT AND METHOD FOR PRODUCING THE SAME

(75) Inventor: John D. Widdemer, Gloversville, NY (US)

(73) Assignee: Bali Leathers, Inc., Johnstown, NY (US)

( * ) Notice: Subject to any disclaimer, the term of this patent is extended or adjusted under 35 U.S.C. 154(b) by 140 days.

(21) Appl. No.: 12/325,876

(22) Filed: Dec. 1, 2008

(65) Prior Publication Data

US 2009/0139006 A1 Jun. 4, 2009

Related U.S. Application Data

(60) Provisional application No. 60/990,958, filed on Nov. 29, 2007.

(51) Int. Cl.
*C14B 17/00* (2006.01)

(52) U.S. Cl. ..... 69/21

(58) Field of Classification Search ..... 69/21; 8/94.1 R, 94.19 R, 94.2
See application file for complete search history.

(56) References Cited

U.S. PATENT DOCUMENTS

| | | | | |
|---|---|---|---|---|
| 5,330,537 | A | | 7/1994 | Stewart et al. |
| 5,709,948 | A | * | 1/1998 | Perez et al. ..... 428/413 |
| 5,725,599 | A | | 3/1998 | Danner et al. |
| 6,132,883 | A | | 10/2000 | McGrath et al. |
| 6,284,311 | B1 | | 9/2001 | Gregorovich et al. |

* cited by examiner

*Primary Examiner*—Shaun R Hurley

(57) ABSTRACT

An ABCITE® reinforced leather and a method for producing the ABCITE® reinforced leather for use in making shoes, gloves and garments are shown. ABCITE® pellets are ground into a fine powder and floated in a carrier so that they penetrate the fiber structure of a tanned skin. The ABCITE® particles bond to the fiber structure and provide enhanced abrasion resistance and tensile strength to the leather. This ABCITE® impregnated leather can be used to make gloves, shoes and garments. Also, ABCITE® powder can be added to the surface to make the surface more durable and abrasion resistant.

23 Claims, 2 Drawing Sheets

RESIN PARTICLE REINFORCED LEATHER PRODUCT AND METHOD FOR PRODUCING THE SAME

CROSS REFERENCE TO RELATED APPLICATIONS

This application claims the priority of provisional application Ser. No. 60/990,958 filed in the United States Patent and Trademark Office on Nov. 29, 2007.

BACKGROUND OF THE INVENTION

A need exists in the leather industry for very soft, flexible leather that is more durable and more resistant to hostile elements such as chemicals, oils and sweat than any currently available. There are many applications that require soft flexible leather and until now durability has been sacrificed for softness. The softest leathers are made from sheepskins because of their inherent loose and open fiber structure. But these qualities reduce the natural abrasion resistance and strength of sheepskin leather which are far less than that of leathers made from stiffer raw materials such as goat, horse, pig, cow or kangaroo skins.

The invention is directed to the field of leather and leather products enhanced by the fixing within the leather fiber structure particles of ABCITE®, one of the strongest, most abrasion resistant materials known.

Natural leather has many advantages over modern synthetics, but abrasion resistance and tensile strength are not among them. Natural leather is softer, breathes better and conforms better to human shapes when used in wearable products than current synthetic leathers. Leather is a by-product of the food industry and hides and skins will always be produced, while synthetic leathers, although stronger, are based on petroleum products which are becoming scarcer and more expensive over time. Therefore a need exists for stronger leather that still retains its favorable characteristics. The invention accomplishes this by converting ABCITE® pellets into a fine powder and inserting them into the leather and chemically bonding them and trapping them in the internal fiber matrix of the leather, reinforcing and strengthening it without affecting its natural softness, breathability and comfort factors.

Many products would benefit from a strength enhanced, soft flexible leather. Examples are: sports gloves requiring good touch and feel transmission such as golf and baseball batting gloves, industrial gloves used for delicate operations such as are required in the computer industry and many other applications where protection and sensitivity are requirements. The invention provides a method for making such leather and a product made from the leather that will increase grip and dexterity and provide extreme durability.

SUMMARY OF THE INVENTION

The invention is generally directed to an ABCITE® (SURLYN®) reinforced leather glove and method for producing the same.

An object of the present invention is to provide soft and flexible leather that is very durable.

Another object of the present invention is to provide a glove that is resistant to harsh elements such as chemicals, oils and sweat.

Yet another object of the present invention is to provide an improved sports and utility glove that is soft and flexible, but has improved grip.

A further object is to provide a method of applying ABCITE® to a leather product such that it is incorporated into the leather material.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the steps in the methods utilized in the process hereinafter set forth and the scope of the invention will be indicated in the Claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

The invention is generally directed to an ABCITE® impregnated leather glove and method for producing the same.

ABCITE® is a thermoplastic compound based on polyolefines that has diverse uses that take advantage of its extreme hardness and strength, including being molded into fence posts, supermarket carts, automotive panels, the outer cover of golf balls and many other applications. In a preferred embodiment ABCITE® (SURLYN®, a trademark owned by DuPont also known as ABCITE®) is used. This product is a tough, thermoplastic resin. More specifically, SURLYN® is an ethylene/methacrylic acid copolymer ionomer resin. This is the same polymer used in the durable outer covering of golf balls and for automotive and other products where resistance to oil spills and other chemical interactions is required. ABCITE® is typically provided in hard pellet form (for instance DuPont's product ABCITE® X70) and is processed by melting at very high temperatures and the resulting liquid is molded into products needing extreme strength such as garden furniture, signs, posts, railings, supermarket carts and other products where extreme durability is required. Applying ABCITE® to leather products by the method disclosed will provide a more durable leather product. In the ease of adapting ABCITE® to leather, these pellets are ground into a fine powder, preferably less than about 250 microns in size and even more preferably less than 125 microns in size, so they can be inserted into the leather's fiber structure. Both ABCITE® and SURLYN® are registered trademarks owned by E.I. du Pont de Nemours and Company of Wilmington, Del.

Figure 1:
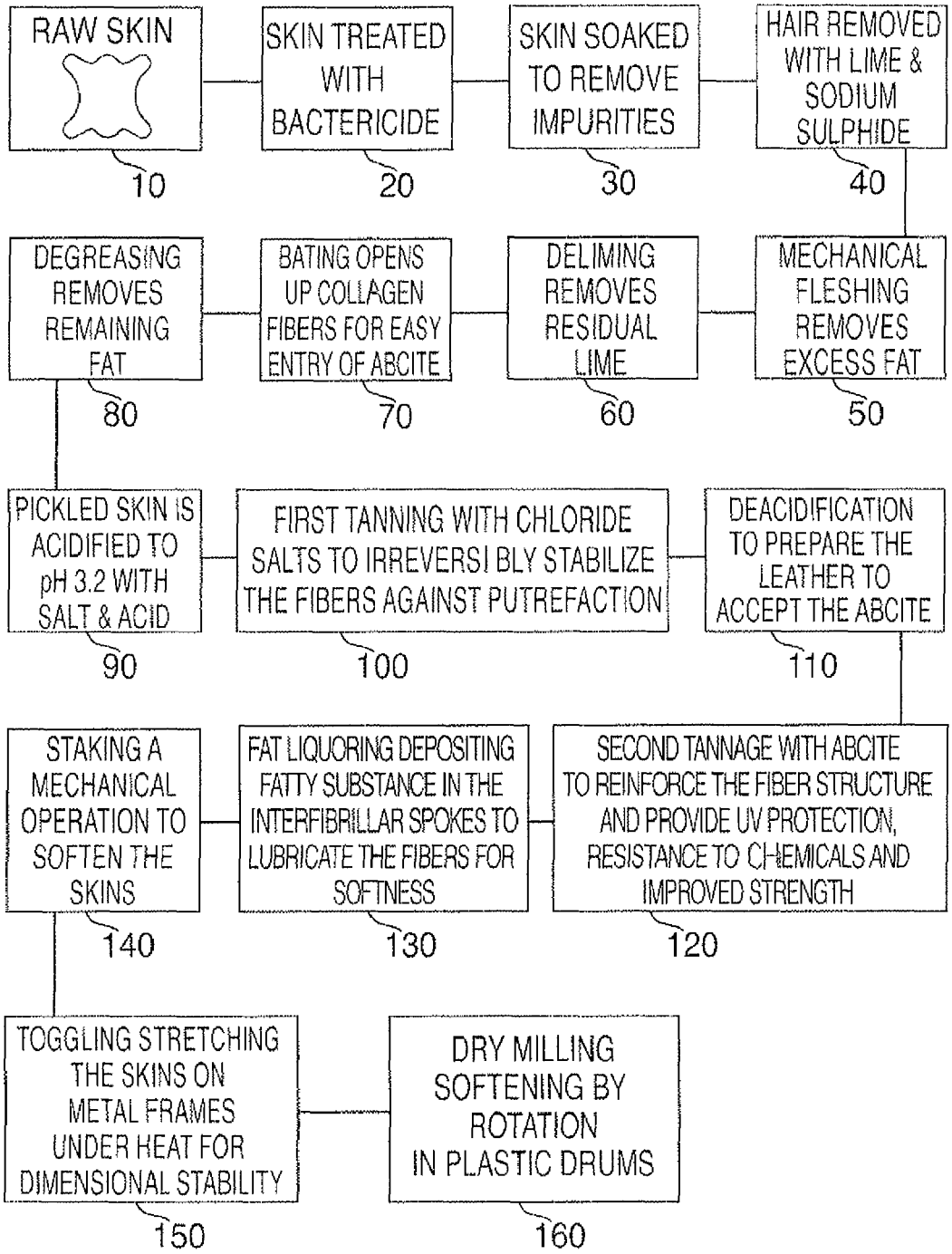
FIG. 1 shows a schematic diagram of the method of creating a reinforced leather product.

In order to insert and fix the ABCITE® particles within leather a step by step preparation of the raw skin to be converted to ABCITE® leather must take place. As shown in FIG. 1, the raw skin 10, taken from the abattoir is treated with bactericide 20 to prevent any weakening of raw skin 10 caused by bacterial action. The skin 10 is then soaked and washed with water and surfactants 30 in a revolving drum to remove all impurities. Next the hair is removed in step 40, using lime and sodium sulphide. Then in step 50 mechanical fleshing with a rotating bladed machine removes surplus flesh and fat from the inside of the skin. Step 60 delimes in a rotating drum to remove any residual lime with sulphuric acid or boric acid. In step 70 bating takes place in a solution of pancreatic bates made from the digestive enzymes of slaughtered animals that opens up the collagen fibers for easy entry of the ABCITE®. In step 80, degreasing by soaking the skins in water at 40 degrees C. and passing them through rollers removes any remaining fat. Then in step 90 the skin is "pickled" (acidified) to pH<3.2 with common salt and sulphuric acid. After aging and draining for up to two weeks to stabilize the chemistry, in step 100 tanning with chrome sulphate takes place to irreversibly stabilize the fiber structure against putrefaction. Next in step 110 deacidification takes place using magnesium or calcium carbonate to prepare the fibers to accept the electrically charged ABCITE® particles. In step 120, a "re-turning" of the ABCITE® particles is conducted to insert the particles into the skin by drumming with a retanning agent such as LUBRITAN® from Rohn and Haas. LUBRITAN® is an acrylic acid/ester-based polymer composition used in the tanning of leather. LUBRITAN® is a registered trademark owned by the Rohm and Haas Company of Philadelphia, Pa. At this point the ABCITE® particles bond to the leather fibers and are trapped within the leather permanently and provide UV protection and improve the leather's strength. In step 130, sulphated oils are drummed into the skin to lubricate the fibers and replace the natural fats earlier removed in step 80. In the final steps 140, 150 and 160 the final product is mechanically softened and shaped for use.

This invention disclosed herein teaches a process that reinforces leather for strength, abrasion resistance, and resistance to chemicals and sweat, while maintaining its softness. Applying a melting process to the ABCITE® pellets would not be practical for leather application because of the high temperatures involved and the hard surface that results after drying. For the leather application, the pellets are first ground into a fine powder, preferably, 250-50 microns and more preferably, 125 microns in particle size. The tanned leather is reworked by a soaking and drumming process that opens up the skin's fiber structure. ABCITE® particles are then added via a carrier for insertion to be chemically bonded to the leather through adjustment of pH. The particles are dispersed in an emulsion of, for example, casein, water, powdered borax, and butyl phenol as a carrier and then are sprayed on the leather surface with a pressure of 50-60 lbs. per sq. inch and dried under controlled temperature conditions preferably ranging from 15 to 20 degrees centigrade.

Figure 2:
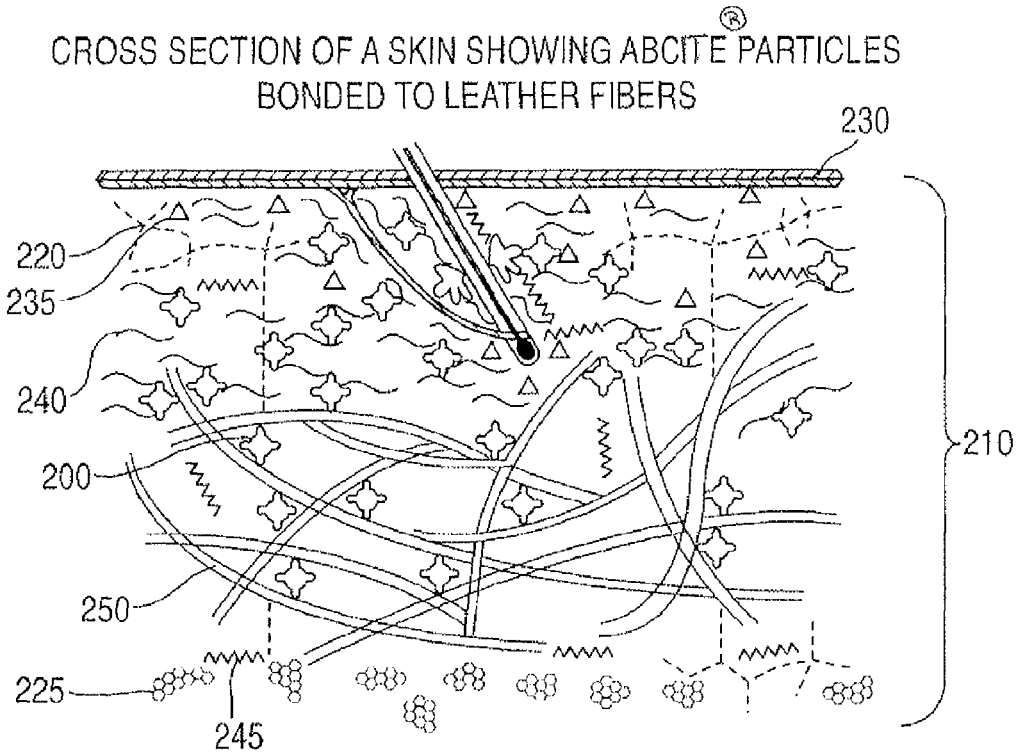
FIG. 2 shows a cross sectional view of the ABCITE® particles bonding to the leather fibers.

The ABCITE® particles are mechanically trapped in the fiber matrix of the leather, both internally, and on the surface. This infusion of ABCITE® particles protects the internal leather fibers against wear from constant flexing and rubbing together which gradually causes weakening and ultimately failure of the leather structure. It also protects the outer fiber layer of the leather from abrasion and from hostile chemical actions which are the two main causes of leather hardening and tearing. FIG. 2 shows a cross section of the leather skin having the ABCITE® particles bonded thereto. The leather skin contains blood vessels 220, tallow glands 225, muscle fiber 230, proteoglycans 235, thin collagen fibers 240, elastin fibers 245 and thick collagen fibers 250. The ABCITE® particles 200 are inserted into the skin 210 of the leather.

Figure 3:
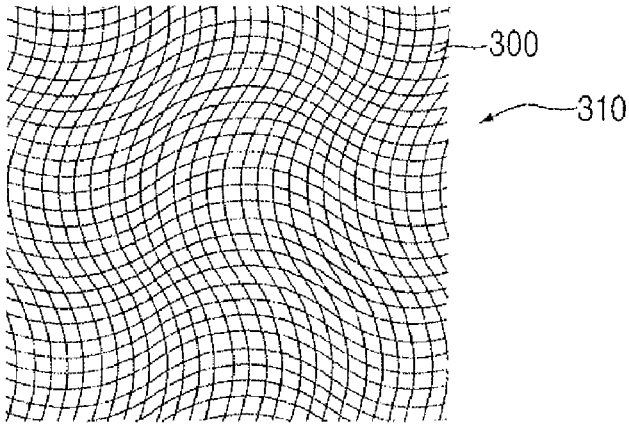
FIG. 3 shows the surface of the ABCITE® impregnated leather.

A need exists for an improved sports and utility glove, shoes and garments that are soft and flexible, but have improved grip and greater durability than currently available products. As shown in FIG. 3, the leather glove that is enhanced with ABCITE® can improve the grip and durability through laser embossing a dimple pattern 300 on the ABCITE® leather surface 310, thereby exposing a maximum area of abrasion resistant ABCITE® and at the same time creating a suction cup effect that on, for instance, a rubber golf club grip, a baseball bat grip or any other implement handle increases traction and prevents slippage. Similar benefits are achieved in shoes and other garments.

It will thus be seen that the objects set forth above, among those made apparent in the preceding description, are efficiently obtained and, since certain changes may be made in the above constructions and processes without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall there between.

What is claimed is:

1. A method of creating a resin particle reinforced leather product comprising:

grinding pellets of an ethylene/methacrylic acid copolymer ionomer resin into a fine powder of particles of said resin;

preparing the leather fiber structure of the leather product to receive said particles;

applying said fine powder to the leather product via a carrier material so that said particles enter the fiber structure of the leather and are bonded to it and are trapped within the leather; and fixing said particles in the fiber structure of the leather product;

whereby said particles trapped within and near the surface of the leather provide enhanced tensile strength and durability to the leather which are important characteristics for longer lasting shoes, gloves and garments.

2. The method of claim 1 wherein said pellets are ground to a powder where the size of said particles is about 125 microns.

3. The method of claim 1 wherein the powder is applied to the leather product by suspending it in a retanning agent.

4. The method of claim 3 wherein the suspended powder is introduced into the fiber structure of the leather by drumming.

5. The method of claim 1 wherein the powder is applied to the leather product by rearming with an acrylic acid/ester-based polymer composition, whereby the particles are bonded to the leather fibers and trapped within the structure of the leather.

6. The method of claim 1 wherein the preparation of the leather fiber structure includes treating raw skin with a bactericide to prevent weakening.

7. The method of claim 1 wherein the preparation of the leather fiber structure includes soaking and washing raw skin with water and surfactants in a revolving drum to remove impurities.

8. The method of claim 1 wherein the step of preparing includes removing hair from raw skin using lime and sodium sulphide solution.

9. The method of claim 1 wherein the preparation of the leather fiber structure includes removing surplus hair and fat from the inside of raw skin by mechanically fleshing with a rotating bladed machine.

10. The method of claim 1 wherein the preparation of the leather fiber structure includes deliming raw skin with a sulphuric acid solution.

11. The method of claim 1 wherein the step of preparing includes opening collagen fibers for easy entry of the particles by bating in a solution of pancreatic bates.

12. The method of claim 1 wherein the step of preparing includes removing remaining fat by degreasing by soaking raw skin in water at 40 degrees Celsius and passing the raw skin through rollers.

13. The method of claim 1 wherein the preparation of the leather fiber structure includes acidifying raw skin to a pH of less than 3.2 by using a common salt and sulphuric acid solution.

14. The method of claim 1 wherein the preparation of the leather fiber structure includes deacidifying the leather using magnesium to prepare the leather fibers to accept the particles.

15. The method of claim 1 wherein the step of applying includes spraying said particles with a carrier onto the leather to add additional durability and tensile strength.

16. The method of claim 1 further comprising the step of laser embossing a dimple pattern on the reinforced leather surface.

17. A resin particle reinforced leather for use in gloves, garments, footwear or other leather products, comprising:

a leather having an internal fiber matrix;

a fine powder of particles of an ethylene/methacrylic acid copolymer ionomer resin, said particles being bonded to the tanned leather in a retaining process so that the particles penetrate the internal fiber matrix of said leather and are trapped within and bonded to the internal fiber matrix;

whereby the trapped particles in the tanned leather internally strengthen the leather, providing enhanced tensile strength and durability to the leather, so that the enhanced leather is particularly suitable for use in gloves, garments, footwear and other leather products requiring tensile strength and durable leather.

18. The reinforced leather of claim 17 wherein the size of said particles is about 125 microns.

19. The reinforced leather of claim 17 further comprising an additional layer of particles with a carrier sprayed onto the leather to add additional durability and abrasion resistance.

20. The reinforced leather of claim 17 wherein a surface of said reinforced leather has a laser embossed dimple pattern.

21. A glove comprising:

a tanned leather having an internal fiber matrix;

a fine powder of particles of an ethylene/methacrylic acid copolymer ionomer resin, said particles being bonded to the tanned leather so that the particles penetrate the internal fiber matrix of said leather and are trapped within and bonded to the internal fiber matrix;

whereby the trapped particles in the tanned leather internally strengthen the leather, providing the leather with enhanced tensile strength and durability.

22. A garment, comprising:

a tanned leather having an internal fiber matrix;

a fine powder of particles of an ethylene/methacrylic acid copolymer ionomer resin, said particles being bonded to the tanned leather so that the particles penetrate the internal fiber matrix of said leather and are trapped within and bonded to the internal fiber matrix;

whereby the trapped particles in the tanned leather internally strengthen the leather, providing the leather with enhanced tensile strength and durability.

23. Footwear, comprising:

a tanned leather having an internal fiber matrix;

a fine powder of particles of an ethylene/methacrylic acid copolymer ionomer resin, said particles being; bonded to the tanned leather so that the particles penetrate the internal fiber matrix of said leather and are trapped within and bonded to the internal fiber matrix;

whereby the trapped particles in the tanned leather internally strengthen the leather, providing the leather with enhanced tensile strength and durability.

* * * * *